US009844264B1

(12) United States Patent
Stewart, III

(10) Patent No.: US 9,844,264 B1
(45) Date of Patent: Dec. 19, 2017

(54) MULTI-TRAY CABINET WITH A COMPOUND OPENING

(71) Applicant: Andrew Stewart, III, Port St. Lucie, FL (US)

(72) Inventor: Andrew Stewart, III, Port St. Lucie, FL (US)

( * ) Notice: Subject to any disclaimer, the term of this patent is extended or adjusted under 35 U.S.C. 154(b) by 0 days.

(21) Appl. No.: 15/299,720

(22) Filed: Oct. 21, 2016

(51) Int. Cl.

| | |
|---|---|
| ***A45C 13/00*** | (2006.01) |
| ***A47B 81/00*** | (2006.01) |
| ***B25H 3/00*** | (2006.01) |
| ***A45C 5/14*** | (2006.01) |
| ***A47B 57/06*** | (2006.01) |
| ***A47B 87/00*** | (2006.01) |
| ***A47B 96/02*** | (2006.01) |
| ***A47B 71/00*** | (2006.01) |
| ***A47B 31/00*** | (2006.01) |
| ***A47B 95/02*** | (2006.01) |

(52) U.S. Cl.

CPC ..... *A47B 81/00* (2013.01); *A45C 5/14* (2013.01); *A45C 13/00* (2013.01); *A47B 31/00* (2013.01); *A47B 57/06* (2013.01); *A47B 71/00* (2013.01); *A47B 87/005* (2013.01); *A47B 95/02* (2013.01); *A47B 96/021* (2013.01); *B25H 3/00* (2013.01); *A47B 2031/003* (2013.01)

(58) Field of Classification Search

CPC ..... B25H 3/02; B25H 3/028; A47B 81/00; A47B 46/00; A47B 46/02; A45C 13/262; A45C 5/14

USPC ..... 312/290, 902; 62/457.1, 457.7; 280/47.26

See application file for complete search history.

(56) References Cited

U.S. PATENT DOCUMENTS

| | | | | | |
|---|---|---|---|---|---|
| 132,998 | A | * | 11/1872 | Yaw | A47B 81/00 190/4 |
| 1,267,388 | A | * | 5/1918 | Dodson | A47B 83/045 211/74 |
| 1,573,466 | A | * | 2/1926 | Ward | A47B 71/00 312/290 |
| 1,924,494 | A | * | 8/1933 | Gelinas | F25D 3/08 190/12 R |

(Continued)

OTHER PUBLICATIONS

Debbie Lamb, Culinary Multi-tasker, webpage, Jun. 5, 2015.
VPT Series Pass-Thru Holding Cabinet w/ 7 Pan Capacity.

*Primary Examiner* — Leslie A Nicholson, III
*Assistant Examiner* — Kimberley S Wright
(74) *Attorney, Agent, or Firm* — Glenn E. Gold, P.A.; Glenn E. Gold; David Colls

(57) ABSTRACT

A multi-tray cabinet includes a cabinet body defining an interior compartment and a compound opening thereto formed by first and second openings merging and in an angular relationship with one another, first and second doors located on the cabinet body adjacent and at an angle relative to one another and being mounted to the cabinet body to undergo movement relative to one another and to the cabinet body in order to correspondingly open and close the first and second openings, pairs of opposing of tray support members attached in a vertically spaced relationship from one pair to another on a pair of opposite interior surfaces of the cabinet body and being aligned with the first opening, and a plurality of trays on respective opposing pairs of tray support members being insertable upon and removable from the tray support members through the first opening.

11 Claims, 10 Drawing Sheets

(56) References Cited

U.S. PATENT DOCUMENTS 1,984,345 A * 12/1934 Kennedy ..... B25H 3/02 206/373
2,215,881 A * 9/1940 Levensten ..... B25H 3/02 232/24
2,286,427 A * 6/1942 Levensten ..... B25H 3/02 190/5
2,739,863 A * 3/1956 Ferris ..... A47B 63/00 312/231
2,878,932 A 3/1959 Martire, Jr.
3,013,852 A * 12/1961 Rockola ..... A47B 69/00 312/117
4,123,128 A * 10/1978 Abele ..... A21B 3/13 211/135
4,433,881 A * 2/1984 Witten ..... H05K 5/0021 312/107
4,659,154 A * 4/1987 Jenkins ..... A01K 97/26 269/907
4,886,286 A * 12/1989 Whorton, III ..... B62B 3/006 188/5
5,102,209 A * 4/1992 Hesseltine ..... A47B 81/00 312/244
5,207,723 A * 5/1993 Newby, Sr. ..... B62B 1/12 280/47.19
5,269,599 A * 12/1993 Moring ..... A47B 46/005 312/290
5,390,798 A 2/1995 Yanuzzi
5,704,699 A * 1/1998 Pagelow ..... A47B 47/05 312/111
5,706,966 A * 1/1998 Rothe ..... A47F 10/06 206/563
6,126,256 A * 10/2000 Doces, II ..... A47B 81/04 211/71.01
6,443,542 B1 * 9/2002 Lindquist ..... A47B 87/008 312/111
6,520,514 B2 * 2/2003 Clegg ..... A45C 5/14 280/47.26
D485,682 S * 1/2004 Wolf ..... D3/291
6,736,265 B2 * 5/2004 Kipper ..... B25H 3/023 206/373
6,761,366 B1 * 7/2004 Klemmensen ..... B25H 3/023 16/113.1
6,955,410 B1 * 10/2005 Nelson ..... A47B 87/008 312/352
D560,099 S 1/2008 Hatcher
7,540,381 B2 * 6/2009 Blasco ..... B65D 25/005 206/449
7,665,811 B2 * 2/2010 Johanning ..... A61G 12/001 312/209
8,157,337 B2 * 4/2012 Manalang ..... B25H 3/021 211/70.6
8,465,030 B2 6/2013 Boivin et al.
8,936,260 B2 1/2015 Burd
D728,931 S * 5/2015 Faupel ..... D3/274
2001/0030403 A1 * 10/2001 Johnson ..... A01K 13/00 280/47.26
2002/0096844 A1 * 7/2002 Clegg ..... A45C 5/14 280/47.17
2002/0117414 A1 * 8/2002 Kipper ..... B25H 3/023 206/373
2006/0279052 A1 * 12/2006 Marmah ..... A47C 1/14 280/47.26
2007/0045973 A1 * 3/2007 Grosso ..... A01K 97/08 280/47.26
2009/0243240 A1 * 10/2009 Boustred ..... B62B 1/14 280/47.19
2012/0176008 A1 * 7/2012 Grela ..... B25H 3/06 312/109
2013/0134003 A1 * 5/2013 Crull ..... A45C 13/26 190/117
2015/0115786 A1 * 4/2015 Manalang ..... B25H 3/028 312/321.5
2016/0213142 A1 * 7/2016 Vestergaard-Jensen A47B 67/00

* cited by examiner

MULTI-TRAY CABINET WITH A COMPOUND OPENING

FIELD OF THE INVENTION

The present invention relates to cabinets for holding trays, and, more particularly, is concerned with a multi-tray cabinet with a compound opening.

BACKGROUND OF THE INVENTION

Multi-tray cabinets (also referred to as carts when mobilized) are known to have a pair of opposite vertical side walls, a top wall, a back wall and a bottom wall defining an interior compartment with a front door mounted along a front vertical edge of one of the side walls for opening and closing a front opening to the compartment. Also, in the compartment racks are vertically spaced on the interiors of the side walls for supporting trays horizontally one above the other in the compartment. Multi-tray cabinets are also known to have an interior compartment with front and rear access openings that may be independently opened and closed by front and rear doors.

Room for sliding trays in and out of interior compartments of these cabinets is typically cramped and so is restricted primarily by a server using only one hand. This is the case whether the cabinet has only a front access opening or both front and rear access openings for reason that the server can only slide a food tray in or out of one of the openings at a time, that being the one opening that accommodates the server's hand.

Accordingly, there is a need in the art for an innovation that will overcome the deficiencies of the known prior art and problems that remain unsolved.

SUMMARY OF THE INVENTION

The present invention is directed to an innovation that overcomes the deficiencies of the known prior art and the problems that remain unsolved by providing a multi-tray cabinet with a compound opening allowing access by both hands of a server to the trays in an interior compartment of the cabinet. The compound opening of the cabinet is provided by two adjacent openings in the cabinet merging with and in an angular relationship to one another.

In one aspect of the present invention, a multi-tray cabinet includes:

- a cabinet body defining an interior compartment and a compound opening to the interior compartment, the compound opening being formed by first and second openings merging with and in an angular relationship to one another;
- first and second doors located on the cabinet body adjacent and at an angle to one another, the first and second doors being mounted to the cabinet body to undergo movement relative to one another and to the cabinet body in order to correspondingly open and close the first and second openings of the compound opening; and
- a plurality of opposing pairs of tray support members attached in a vertically spaced relationship from one pair to another on a pair of opposite interior surfaces of the cabinet body and being aligned with the first opening of the compound opening.

In another aspect of the present invention, the first and second openings are front and top openings merging with and extending in a transverse relationship to one another and, more specifically, at a right angle to one another.

In another aspect of the present invention, the cabinet body is mobilized by at least a pair of rear wheels disposed proximate opposite lower rear corners formed by a pair of opposite side walls and a rear wall of the cabinet body. Further, a steering arm is attached to and extendable above the rear wall of the cabinet body.

In another aspect of the present invention, a plurality of trays are removably and slidably supported on and extend between the pairs of vertically spaced tray support members. At least one of the trays has cutouts that removably receive receptacles.

In another aspect of the present invention, a multi-tray cabinet includes:

- a cabinet body comprising a pair of opposite spaced apart vertical side walls, a horizontal bottom wall and a vertical rear wall defining and partially surrounding an interior compartment and defining a compound opening to the interior compartment, the compound opening being formed by front and top openings merging with and in an angular relationship to one another;
- front and top doors located on the cabinet body adjacent and at an angle to one another, the front and top doors being mounted to the cabinet body to undergo movement relative to one another and to the cabinet body in order to correspondingly open and close the front and top openings of the compound opening; and
- a plurality of opposing pairs of tray support members attached in a vertically spaced relationship from one pair to another on opposite interior surfaces of the pair of opposite spaced apart vertical side walls and being aligned with the front opening of the compound opening.

In another aspect of the present invention, the front opening of the compound opening extends from a horizontal front edge of the horizontal bottom wall of the cabinet body and upwardly between vertical front edges of the opposite spaced apart vertical side walls of the cabinet body. Further, the top opening of the compound opening extends rearwardly between horizontal top edges of the opposite spaced apart vertical side walls of the cabinet body to a horizontal top edge of the vertical rear wall of the cabinet body. The front and top openings merge with and extend in a transverse relationship to one another and, more specifically, at a right angle to one another.

In another aspect of the present invention, a multi-tray cabinet includes:

- a connected pair of cabinet bodies each comprising a pair of opposite spaced apart vertical side walls, a horizontal bottom wall and a vertical rear wall defining and partially surrounding an interior compartment, at least one of the cabinet bodies defining a compound opening to the interior compartment thereof, the compound opening being formed by front and top openings merging with and in an angular relationship to one another;
- a pair of front and top doors located on the at least one of the cabinet bodies adjacent and at an angle to one another, the pair of front and top doors being mounted to the at least one of the cabinet bodies to undergo movement relative to one another and to the cabinet body in order to correspondingly open and close the front and top openings of the compound opening; and
- a plurality of opposing pairs of tray support members in the at least one of the cabinet bodies being attached in a vertically spaced relationship from one pair to another on opposite interior surfaces of the pair of opposite spaced apart vertical side walls and being aligned with the front opening of the compound opening of the at least one of the cabinet bodies, wherein the pair of cabinet bodies are mobilized by at least a pair of rear wheels disposed proximate opposite lower rear corners of the cabinet bodies and have a steering arm attached to the cabinet bodies between and extendable above the rear walls of the cabinet bodies.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
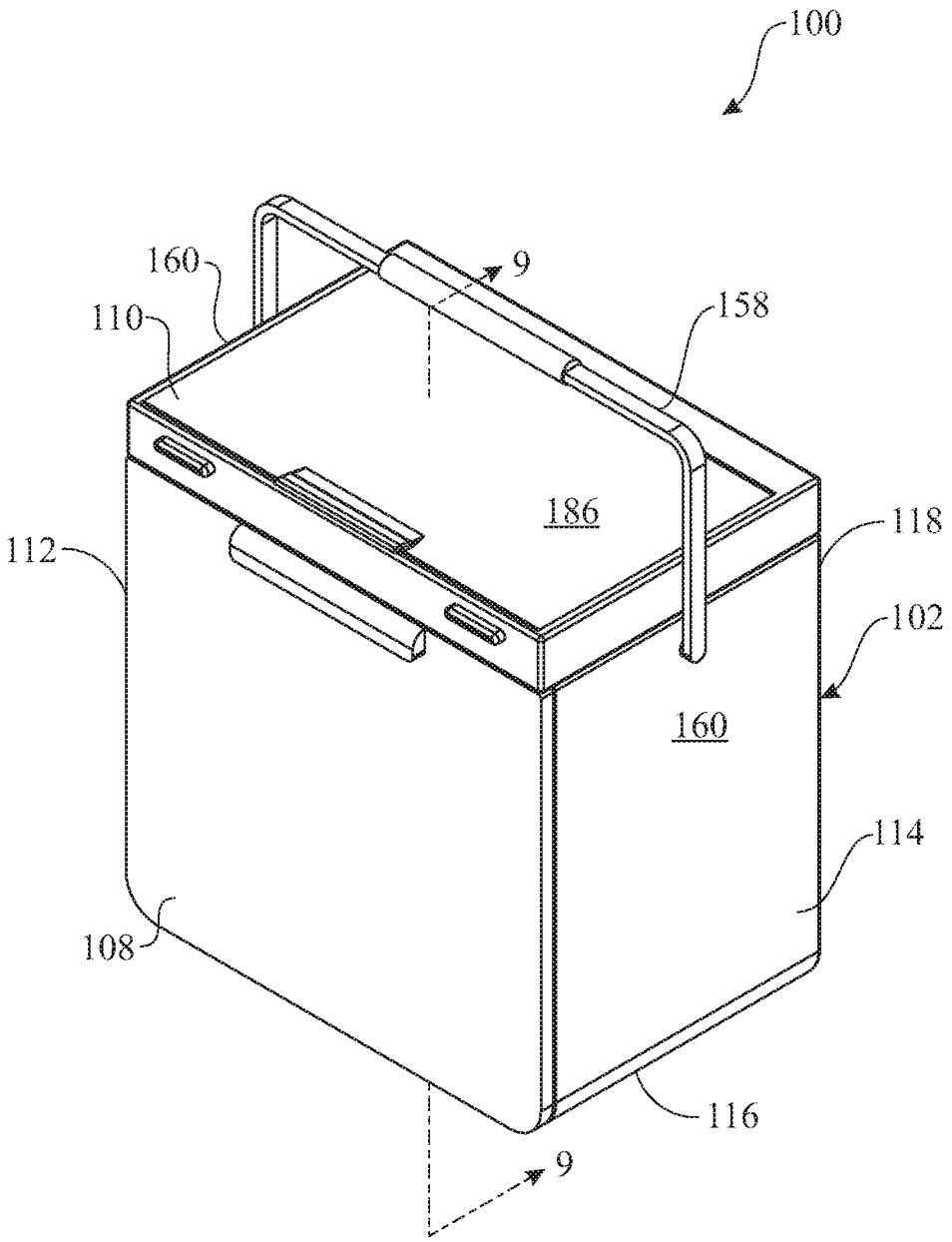
FIG. 1 presents a front isometric view of an exemplary embodiment of a multi-tray cabinet having a compound opening being shown in a closed condition by both front and top doors being in closed positions.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-5 and 9, there is illustrated an exemplary embodiment of a multi-tray cabinet in accordance with aspects of the present invention, being generally designated 100. The cabinet 100 includes a cabinet body 102 defining an interior compartment 104 and a compound opening 106 to the interior compartment 104. The cabinet 100 also includes a pair of front and top doors 108, 110 located on the cabinet body 102 adjacent and at an angle to one another. The front and top doors 108, 110 are mounted to the cabinet body 102 to undergo movement relative to one another and to the cabinet body 102 in order to open and close the compound opening 106.

Figure 9:
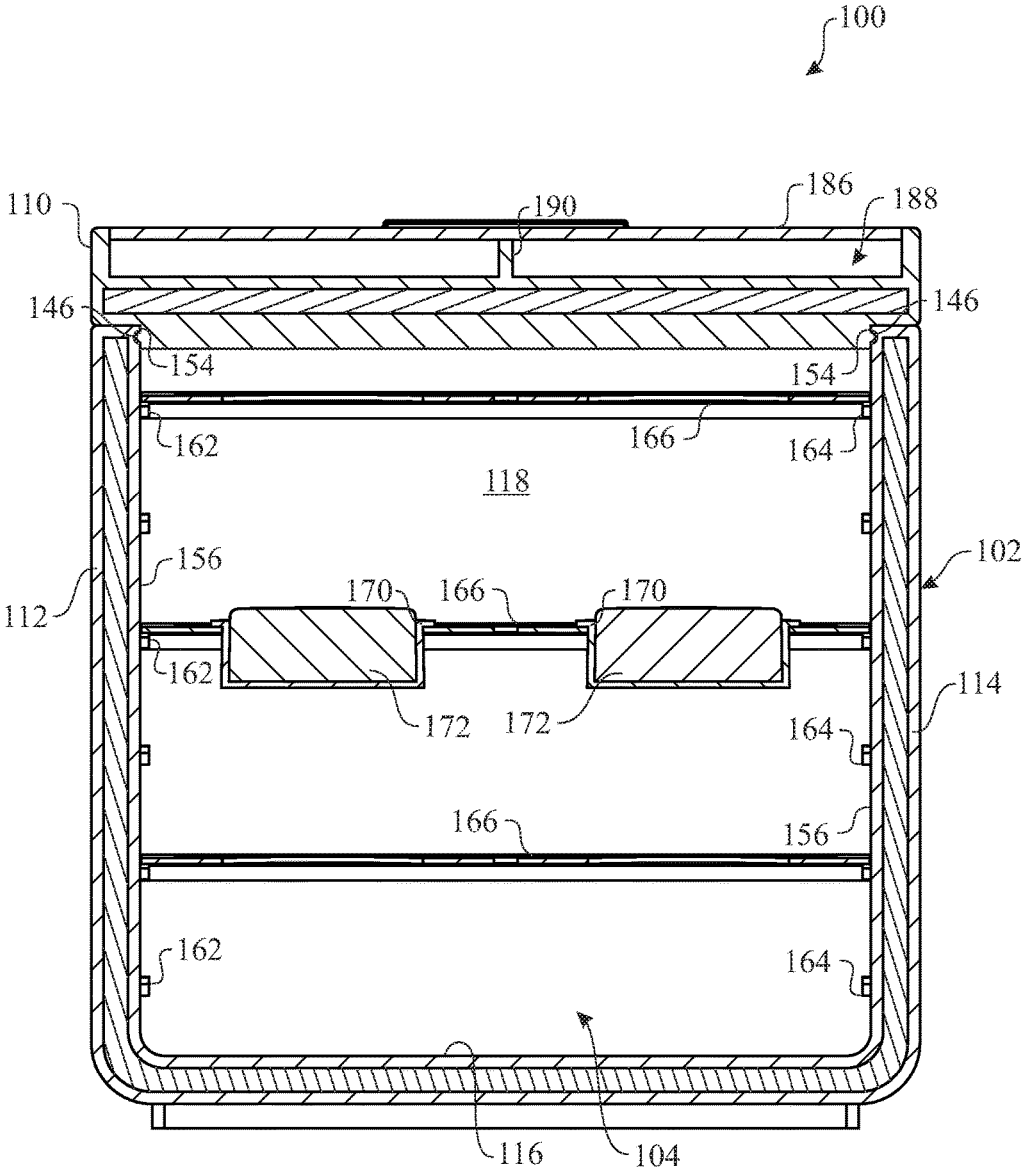
FIG. 9 presents an enlarged cross-section view taken along section line 9-9 of FIG. 1.

More particularly, the cabinet body 102 is formed by a plurality of interconnected walls, for example, a pair of opposite spaced apart vertical side walls 112, 114, a horizontal bottom wall 116 and a vertical rear wall 118. These interconnected walls 112, 114, 116, 118 define and partially surround the interior compartment 104 and define the compound opening 106 thereto. In FIG. 9, there is shown an insulated construction of the cabinet body 102 incorporated by the interconnected walls. The compound opening 106 includes a front opening 120, extending from a horizontal front edge 122 of the horizontal bottom wall 116 and upward between vertical front edges 124, 126 of the opposite spaced apart vertical side walls 112, 114, and a top opening 128, merging with the front opening 120 and extending rearward between horizontal top edges 130, 132 of the opposite vertical side walls 112, 114 to a horizontal top edge 134 of the vertical rear wall 118. The front opening 120 and top opening 128 extend transversely, or at a right angle, to one another.

Front and top doors 108, 110 of the cabinet 100 have respective hinges 136, 138 connecting them to the cabinet body 102 so that the doors may undergo pivotal movement relative thereto in order to open and close the front and top openings 120, 128 of the compound opening 106. The lower edge 140 of the front door 108 is pivotally connected by the hinge 136 to the horizontal front edge 122 of the horizontal bottom wall 116 of the cabinet body 102. The rear edge 142 of the top door 110 is pivotally connected by a pair of hinges 138 to the horizontal top edge 134 of the vertical rear wall 118 of the cabinet body 102.

Figure 4:
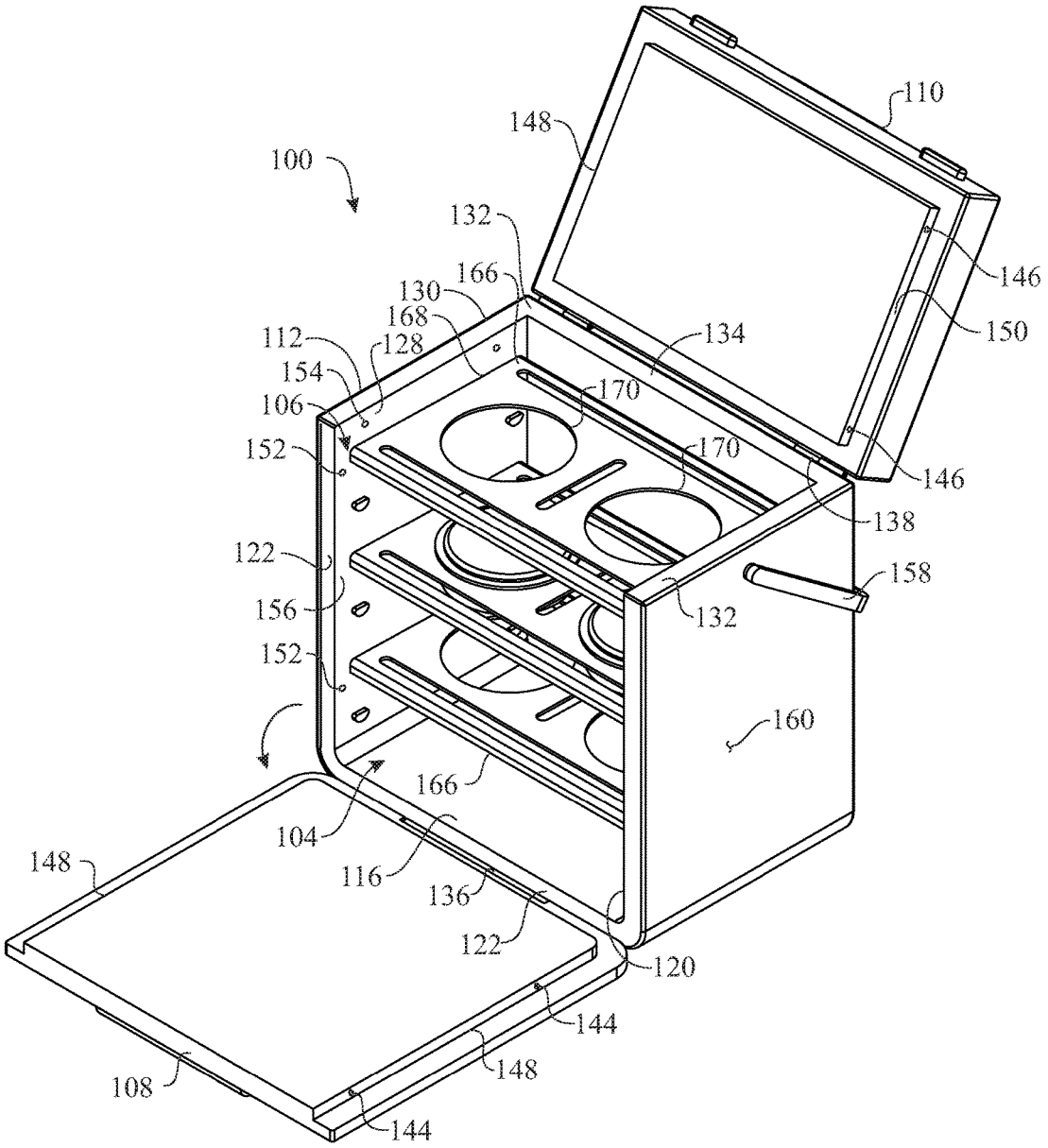
FIG. 4 presents a front isometric view of the cabinet originally introduced in FIG. 1, illustrated with its compound opening being shown in a fully opened condition by its front and top doors being in opened positions.

Also, the front and top doors 108, 110 and the cabinet body 102 have latches which may take the form of protrusions 144, 146 formed on opposite side inset peripheral edges 148, 150 of the front and top doors 108, 110, and depressions 152, 154 formed in front and top peripheral edge portions of respective interior surfaces 156 of the opposite spaced apart vertical side walls 112, 114 of the cabinet body 102. The protrusions 144, 146 on the front and top doors 108, 110 respectively align and mate, or latch, with the depressions 152, 154 on the cabinet body 102 so as to retain the respective front and top doors 108, 110 at their closed positions relative to the compound opening 106 in the cabinet body 102, as seen in FIG. 1. The protrusions 144, 146 respectively become unmated, or unlatched, from the depressions 152, 154 when the respective front and top doors 108, 110 are pulled to pivotally move them from their closed positions toward their opened positions relative to the compound opening 106 in the cabinet body 102, as seen in FIG. 4. The mating, or latching, and unmating, or unlatching, actions of the protrusions 144, 146 relative to the depressions 152, 154 may, by way of example but not limitation, be provided in accordance with conventional spring-loading or press-fitting technologies.

Figure 2:
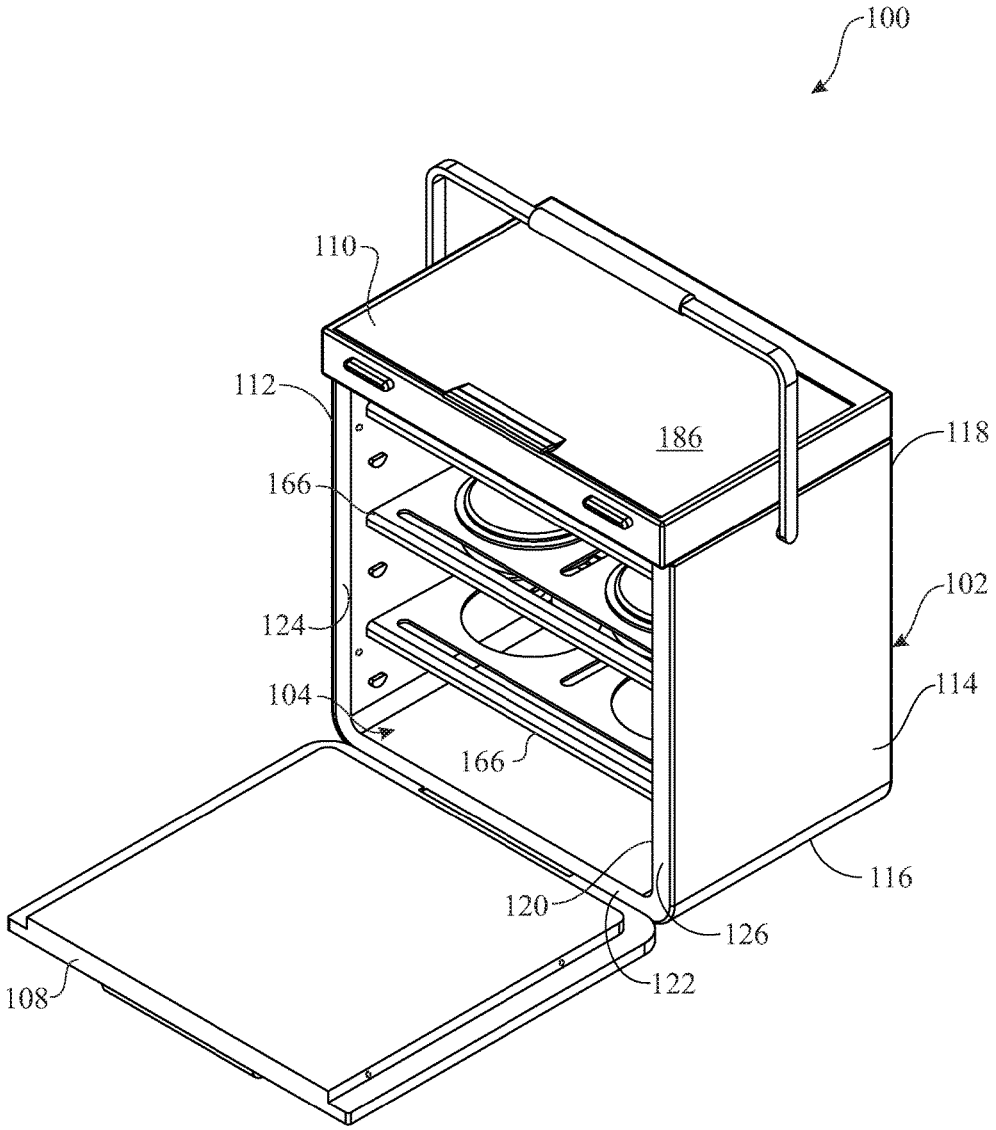
FIG. 2 presents a front isometric view of the cabinet originally introduced in FIG. 1, illustrated with its compound opening being shown in a partially opened condition by its front door being in an opened position with its top door still in the closed position.
Figure 5:
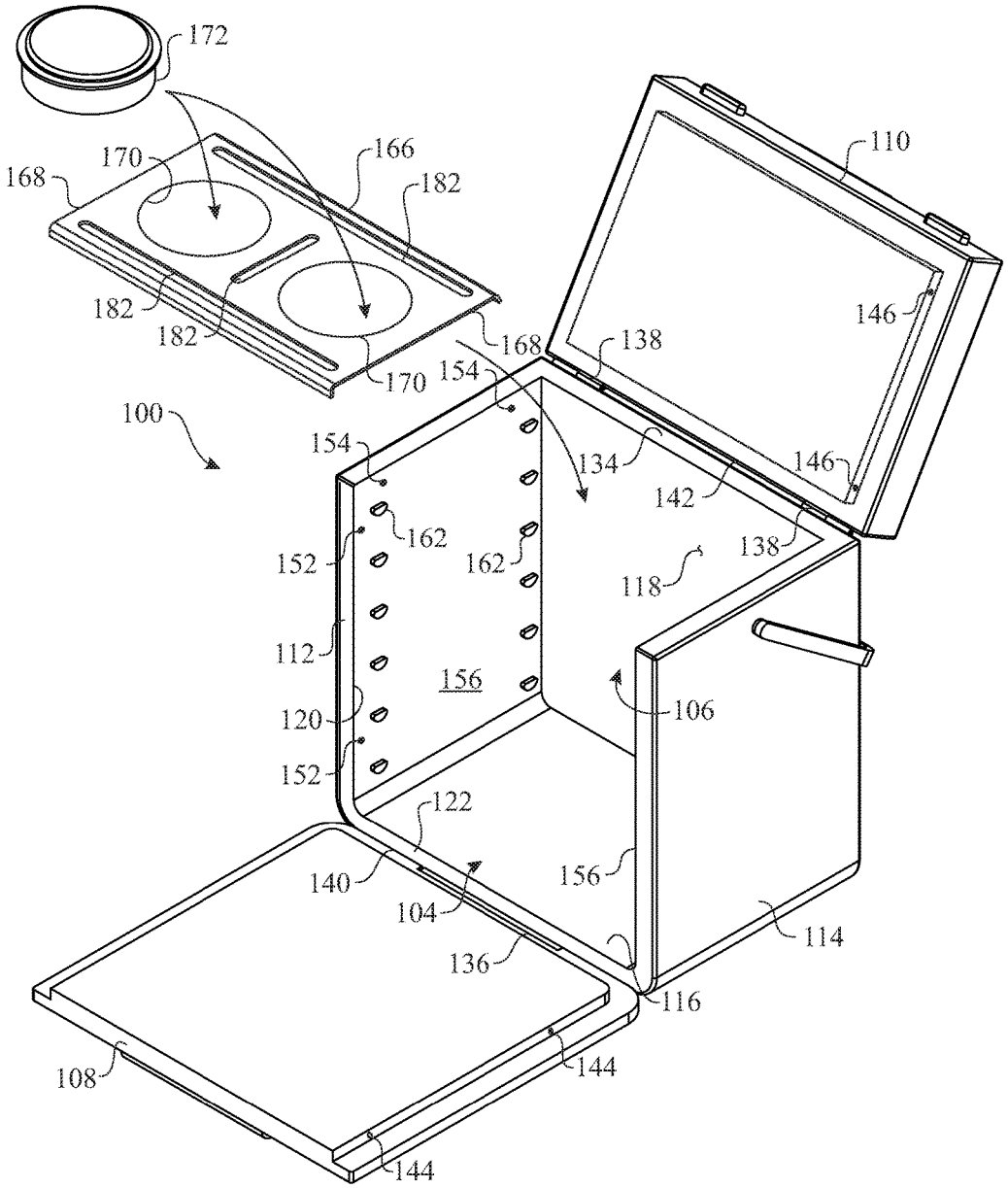
FIG. 5 presents a front isometric view of the cabinet originally introduced in FIG. 1, being illustrated with the cabinet empty and an exemplary embodiment of a tray and two receptacles in an exploded relationship to the empty cabinet.

The cabinet 100 also may have a handle 158, for example, of an inverted U-shaped configuration, mounted at its opposite ends to respective exterior surfaces 160 of the opposite spaced apart vertical side walls 112, 114 of the cabinet body 102. Manipulation of the handle 158 enables it to undergo pivotal movement between an upright position, as seen in FIGS. 1 and 2, and a stored position, as seen in FIGS. 3-5.

Figure 6:
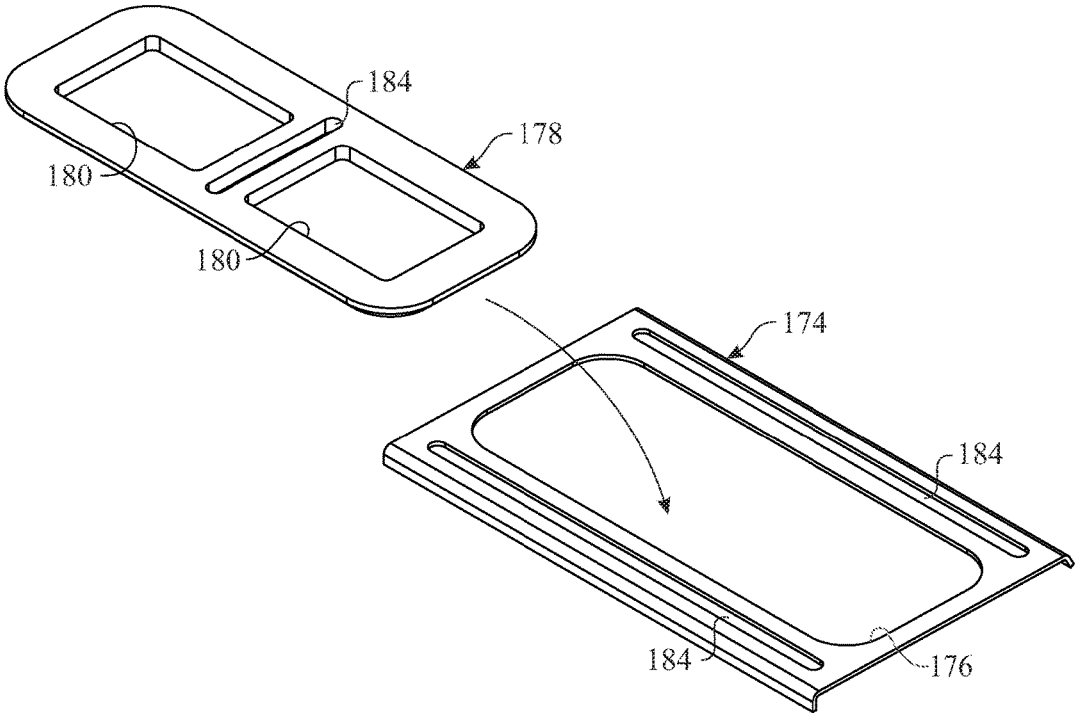
FIG. 6 presents a front exploded isometric view of an alternative embodiment of a tray that may be employed with or in place of the tray shown in FIG. 5.

The multi-tray cabinet 100 further includes a plurality of opposing pairs of tray support members 162, 164 attached in a vertically spaced relationship from one pair to another on the respective interior surfaces 156 of the opposite spaced apart vertical side walls 112, 114 of the cabinet body 102. The pairs of tray support members 162, 164 are provided in rows that align with the front opening 120 of the compound opening 106. The multi-tray cabinet 100 still further includes a plurality of trays 166 extending between the pairs of vertically spaced tray support members 162, 164 and being removably and slidably supported at their opposite end edges 168 on the tray support members 162, 164. The trays 166 may have cutouts 170 that removably receive receptacles 172. FIG. 6 shows an alternative design of an outer tray 174 having a cutout 176 for nesting an inner tray 178 that also has cutouts 180 for removably receiving receptacles (not shown). All designs of the trays 166, 174, 178 may have slots 182, 184 for stiffening and/or reducing the respective weight thereof.

Figure 3:
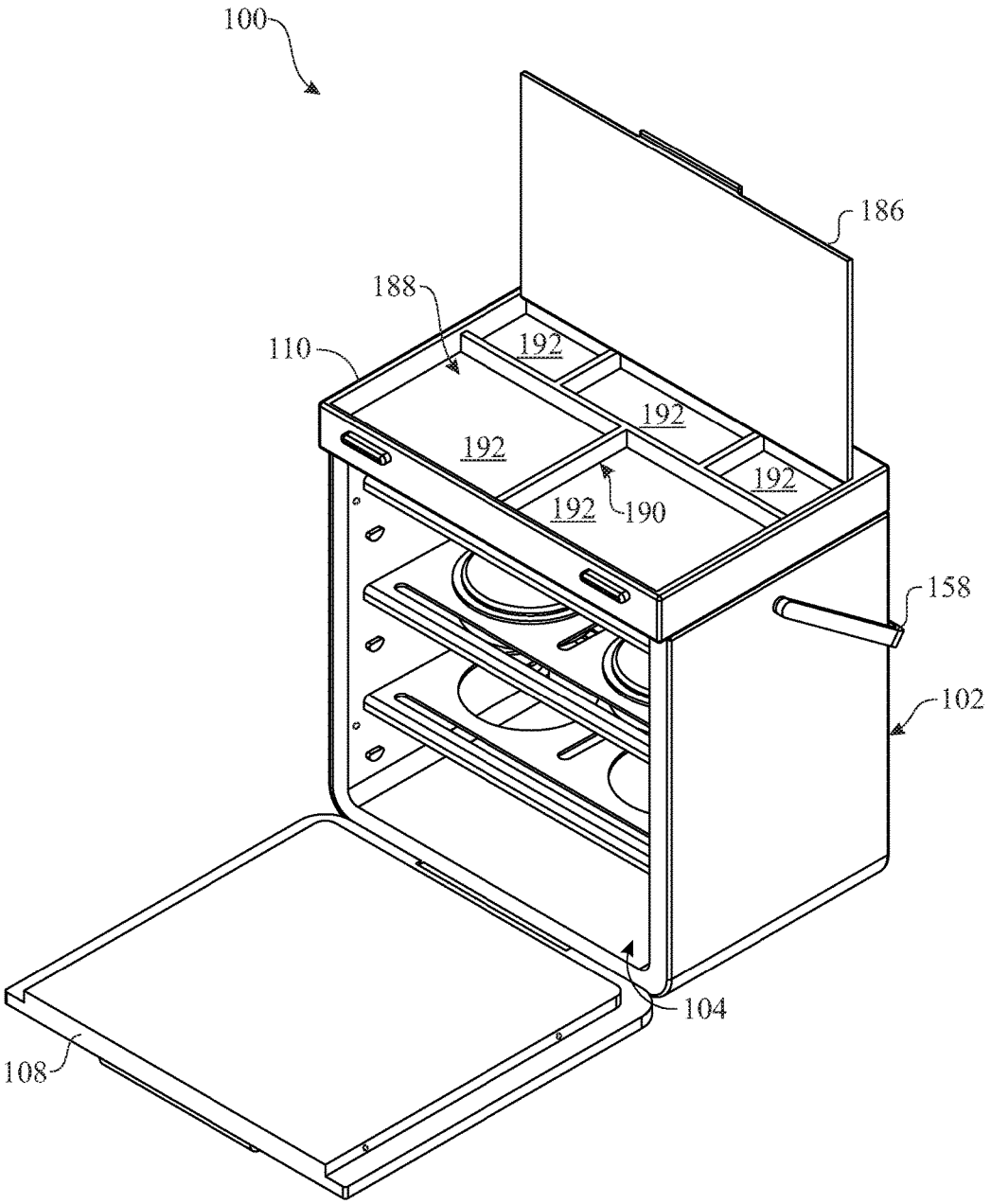
FIG. 3 presents a front isometric view of the cabinet similar to as shown in FIG. 2, but now with a lid on the top door being shown in an opened position with the top door still in the closed position.
Figure 7:
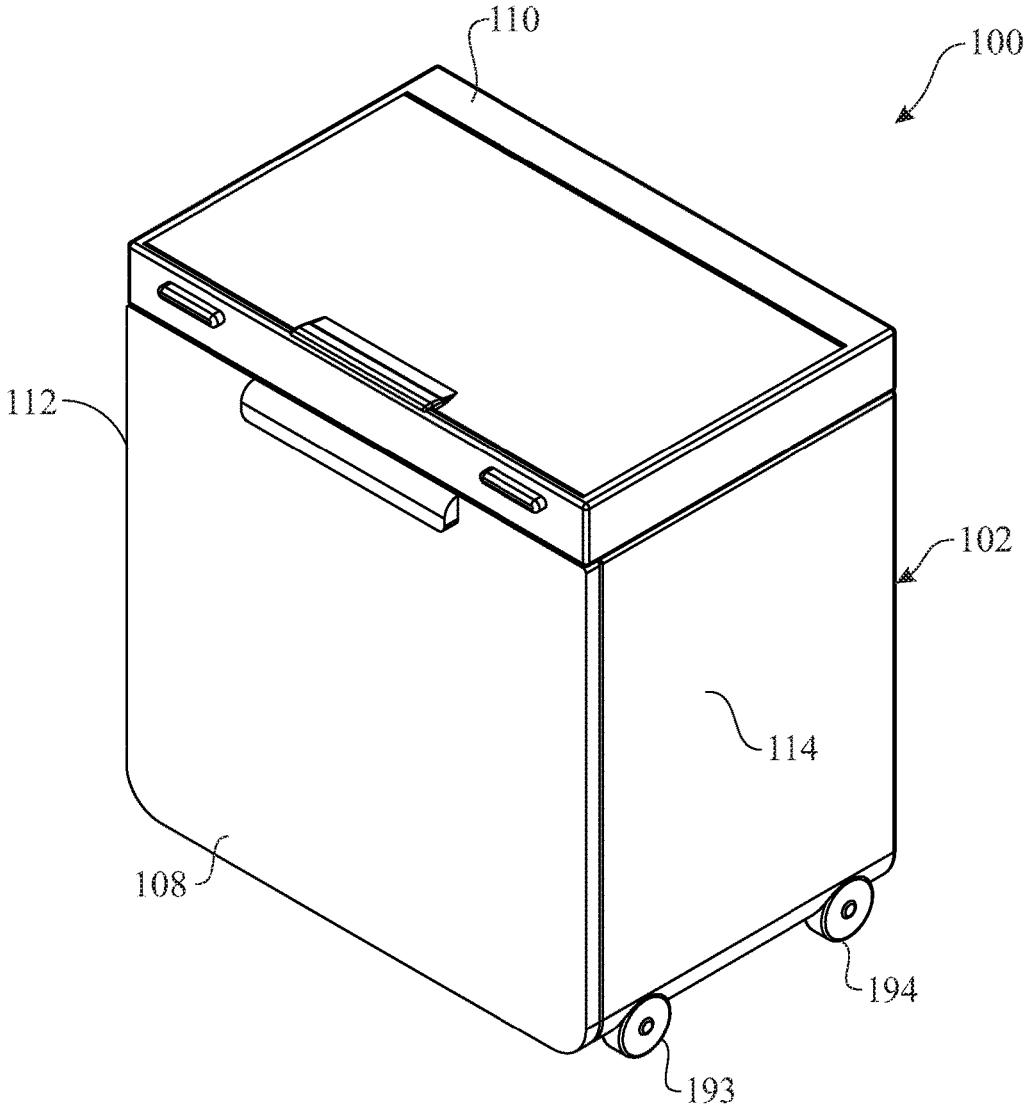
FIG. 7 presents a front isometric view of the cabinet originally presented in FIG. 1 now mobilized with rollers.
Figure 8:
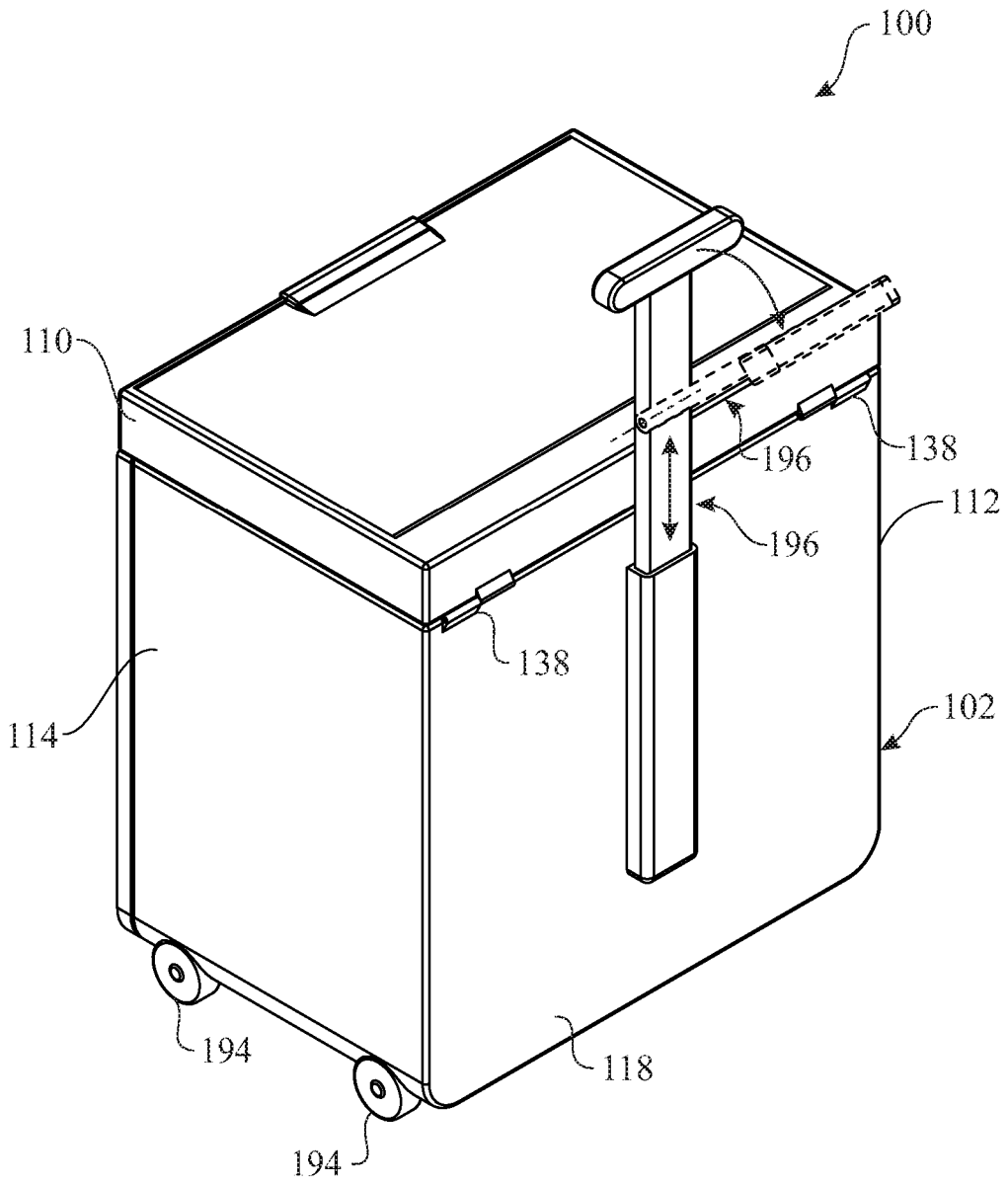
FIG. 8 presents a rear isometric view of the mobile cabinet originally presented in FIG. 7 now illustrated having a steering arm thereon.
Figure 10:
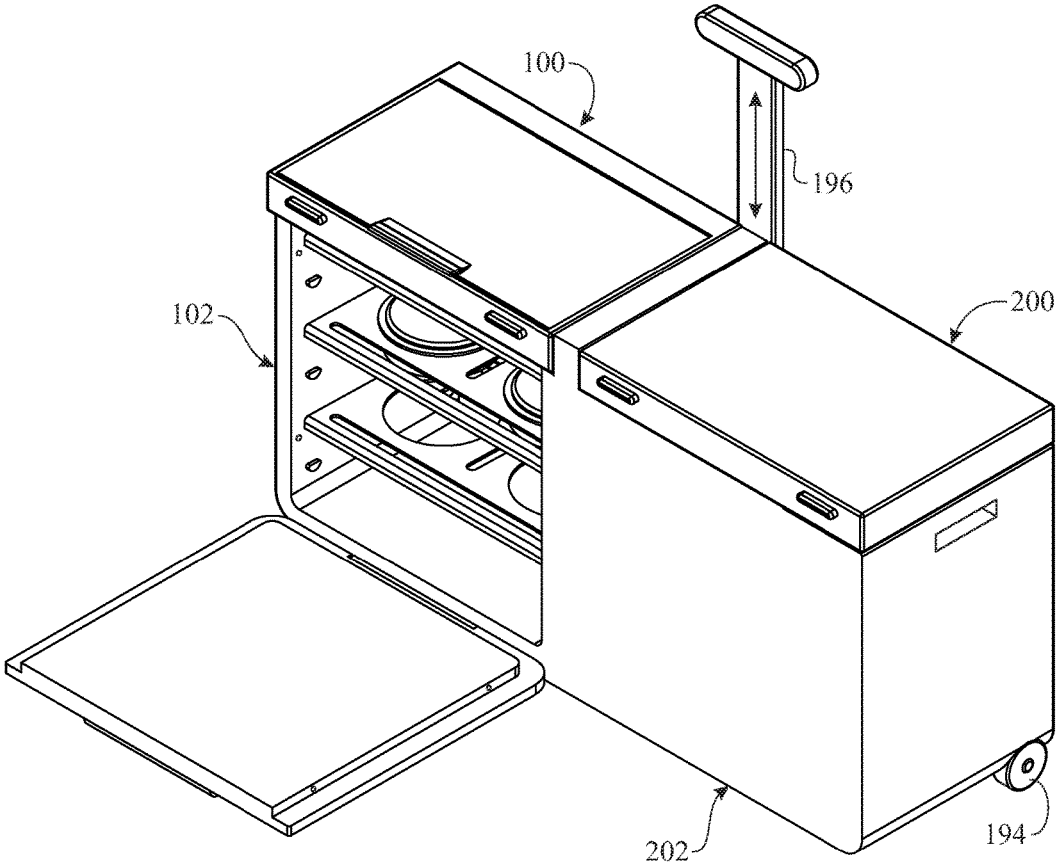
FIG. 10 presents an isometric view of an alternative exemplary embodiment of a mobile cabinet with dual compartments and a steering arm thereon.

Turning now to FIGS. 3, 7, 8 and 10, there is illustrated various additions to and modifications of the cabinet 100. In FIG. 3 there is shown an auxiliary lid 186 mounted on the top door 110 and pivoted to an opened position with the top door 110 being still in the closed position. The open lid 186 exposes a hidden compartment 188 built into the top door 110 having an interior wall unit 190 that divides the compartment 188 into separate sub-compartments 192. In FIGS. 7 and 8 the cabinet 100 is shown mobilized by rear wheels 194 located and mounted proximate opposite lower rear corners formed by the pair of opposite spaced apart vertical side walls 112, 114 and the vertical rear wall 118 of the cabinet body 102. In FIG. 10 there is shown another exemplary embodiment of a modified cabinet 200 having a modified cabinet body 202 connected to a respective one cabinet body 102. Also, in FIG. 8 there is shown a steering arm 196 attached to and extendable above the vertical rear wall 118 of the cabinet body 102. In FIG. 10 connected pair of cabinet bodies 102, 202 are mobilized by rear wheels 194 (only one being shown) and may be guided by the steering arm 196 attached to and extendable above a rear wall thereof.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A portable multi-tray food delivery cabinet for maintaining the warmth of food contained therein, the food delivery cabinet comprising:

a primary cabinet body having a pair of opposite spaced apart vertical side walls, a horizontal bottom wall and a vertical rear wall, said side walls, bottom wall and rear wall interconnected to define a contiguous primary cabinet body interior compartment absent any interior partitioning structure, and a compound opening to said interior compartment, said compound opening being formed by first and second openings merging with and in an angular relationship to one another;

first and second doors located on said primary cabinet body adjacent and at an angle to one another, said first and second doors being mounted to said cabinet body to undergo movement relative to one another and to said cabinet body in order to correspondingly open and close said first and second openings of said compound opening;

a secondary cabinet body disposed atop an upper one of said first and second primary cabinet body doors, said secondary cabinet body having a secondary cabinet body lid, wherein said secondary cabinet body and lid together define a secondary cabinet body interior compartment completely isolated from said contiguous primary cabinet body interior compartment; and a plurality of opposing pairs of tray support members attached in a vertically spaced relationship from one pair to another on a pair of opposite interior surfaces of said cabinet body and being aligned with said first opening of said compound opening; and at least one food-supporting tray spanning said pair of opposite spaced apart vertical side walls and supported by at least one of said plurality of opposing pairs of tray support members, said food-supporting tray having at least one interior cutout having a shape conforming to a peripheral shape of a food item to be seated therein.

2. The multi-tray cabinet of claim 1 wherein said first opening of said compound opening extends from a horizontal front edge of a horizontal bottom wall of said plurality of interconnected walls and upwardly between vertical front edges of opposite spaced apart vertical side walls of said plurality of interconnected walls.

3. The multi-tray cabinet of claim 1 wherein said second opening of said compound opening extends rearwardly between horizontal top edges of opposite spaced apart vertical side walls of said plurality of interconnected walls to a horizontal top edge of a vertical rear wall of said plurality of interconnected walls.

4. The multi-tray cabinet of claim 1 wherein said first and second openings are front and top openings merging with and extending in a transverse relationship to one another.

5. The multi-tray cabinet of claim 4 wherein said front and top openings extend at a right angle to one another.

6. The multi-tray cabinet of claim 1 wherein said primary cabinet body is mobilized by at least a pair of rear wheels disposed proximate opposite lower rear corners formed by a pair of opposite side walls and a rear wall of said plurality of interconnected walls.

7. The multi-tray cabinet of claim 6 further comprising a steering arm attached to and extendable above said rear wall of said cabinet body.

8. The multi-tray cabinet of claim 1 wherein said at least one food-supporting tray is removably and slidably supported on and extends between at least one of said pairs of vertically spaced tray support members.

9. The multi-tray cabinet of claim 1 wherein said primary cabinet body further comprising a connected pair of primary cabinet bodies, at least one of said pair of primary cabinet bodies having said compound opening and a pair of said first and second doors located thereon.

10. The multi-tray cabinet of claim 9 wherein said pair of primary cabinet bodies is mobilized by at least a pair of rear wheels disposed proximate opposite lower rear corners of said primary cabinet bodies.

11. A multi-tray cabinet, comprising:

a connected pair of cabinet bodies each comprising a pair of opposite spaced apart vertical side walls, a horizontal bottom wall and a vertical rear wall defining and partially surrounding an interior compartment, at least one of said cabinet bodies defining a compound opening to said interior compartment thereof, said compound opening being formed by front and top openings merging with and in an angular relationship to one another;

a pair of front and top doors located on said at least one of said cabinet bodies adjacent and at an angle to one another, said pair of front and top doors being mounted to said at least one of said cabinet bodies to undergo movement relative to one another and to said cabinet body in order to correspondingly open and close said front and top openings of said compound opening; and a plurality of opposing pairs of tray support members in said at least one of said cabinet bodies being attached in a vertically spaced relationship from one pair to another on opposite interior surfaces of said pair of opposite spaced apart vertical side walls and being aligned with said front opening of said compound opening of said at least one of said cabinet bodies, wherein said pair of cabinet bodies are mobilized by at least a pair of rear wheels disposed proximate opposite lower rear corners of said cabinet bodies and having a steering arm attached to said cabinet bodies between and extendable above said rear walls of said cabinet bodies.

* * * * *